United States Patent [19]

Lausch

[11] Patent Number: 4,461,802

[45] Date of Patent: Jul. 24, 1984

[54] BOW AND SKEW RESISTANT PLAIN-WEAVE POLYOLEFIN

[75] Inventor: Robert C. Lausch, Ephrata, Pa.

[73] Assignee: Armstrong World Industries, Inc., Lancaster, Pa.

[21] Appl. No.: 453,741

[22] Filed: Dec. 27, 1982

[51] Int. Cl.[3] ..... D06M 15/26; D06M 15/36

[52] U.S. Cl. ..... 428/229; 427/389.9; 428/95; 428/96; 428/255; 428/272; 428/288; 428/338; 428/339

[58] Field of Search ..... 428/95, 96, 229, 255, 428/272, 288, 338, 339; 427/389.9

[56] References Cited

U.S. PATENT DOCUMENTS

| | | | |
|---|---|---|---|
| 4,064,686 | 12/1977 | Whitted et al. | 28/276 |
| 4,095,320 | 6/1978 | Polney | 28/272 |
| 4,145,467 | 3/1979 | Malik | 28/112 |
| 4,223,520 | 9/1980 | Whitted et al. | 28/276 |
| 4,239,563 | 12/1980 | Iacoviello | 428/96 |
| 4,258,094 | 3/1981 | Benedyk | 156/72 |

*Primary Examiner*—James C. Cannon
*Attorney, Agent, or Firm*—Laird F. Miller

[57] ABSTRACT

The present invention relates to plain-weave polyolefin fabric and to a method of producing it. The fabric is treated with a relatively low level of vinyl acetate-ethylene copolymer emulsion to provide an inexpensive fabric which is resistant to bow and skew.

28 Claims, No Drawings

BOW AND SKEW RESISTANT PLAIN-WEAVE POLYOLEFIN

The present invention relates to synthetic open-weave fabric and more particularly to inexpensive polyolefin open-weave fabric which is resistant to bow and skew.

BACKGROUND OF THE INVENTION

Synthetic open-weave fabric is coming into wide use in the carpet industry and among the least expensive backings are the polyolefin fabrics, such as polypropylene. Fabrics derived from these materials are most economically produced as air textured plain-weave materials.

PRIOR ART

A number of U.S. patents are directed to the production of air-textured fibers. For example, U.S. Pat. No. 4,095,320 and related patents disclose a texturing jet which is useful to prepare continuously entangled yarns, and U.S. Pat. Nos. 4,064,686 and 4,223,520 disclose information relating to nodally entangled yarns.

Although fabrics may be cheaply produced from these yarns, they suffer from a major defect in that they do not exhibit dimensional stability. Thus, when such materials are used as carpet backings and are exposed to conventional processes designed to adhere a secondary backing to a primary backing, fabrics prepared from air-textured polyolefin materials are usually found to be unsatisfactory because they easily bow and skew. To avoid these problems, artisans have resorted to the use of heavier denier yarns, dissimilar yarns and special weaves to produce stable fabrics; however, such fabrics are more expensive than plain-weave fabrics and the advantages obtained by using woven synthetics of this type are diminished in proportion to the increase in cost.

Accordingly, one objective of the present invention is to provide an inexpensive air-textured polyolefin fabric which is resistant to bow and skew.

Another objective of the present invention is to provide a process whereby such fabrics can be produced.

Yet another objective of the present invention is to provide an inexpensive polyolefin fabric which is useful as a carpet backing.

These and other advantages of the present invention will become apparent from the detailed description of preferred embodiments which follow.

SUMMARY OF THE INVENTION

The present invention relates to plain-weave polyolefin fabric and to a method of producing it. The fabric is treated with a relatively low level of vinyl acetate-ethylene copolymer emulsion to provide an inexpensive fabric which is resistant to bow and skew.

DETAILED DESCRIPTION OF PREFERRED EMBODIMENTS

In one embodiment the present invention relates to bow and skew resistant plain-weave polyolefin fabric, said fabric comprising air-textured yarn and being coated with a vinyl acetate-ethylene copolymer emulsion at a dry weight deposition level of from about 0.02 to about 3.0 ounces per square yard of fabric, said emulsion comprising not more than about 25% solids by weight.

In a second embodiment the present invention relates to a process for preparing a bow and skew resistant plain-weave polyolefin fabric, said process comprising the steps of selecting a plain-weave polyolefin fabric prepared from air textured yarn; treating said fabric with a vinyl acetate-ethylene copolymer emulsion comprising not more than about 25% solids by weight, said emulsion being applied at a dry-weight level of about 0.02 to about 3.0 ounces per square yard of fabric; and drying said fabric.

The term "plain weave" commonly refers to a fabric in which each filling yarn passes successively over and under each warp yarn, alternating each row. However, variations of plain-weaves are known in the art whereby, for example, the filling yarn passes over two strands of warp yarn. All such variations are considered to be within the purview of the present invention and, therefore, "plain weave" as used herein will be considered to include those weaves in which the fibers are not mechanically locked in place. Thus, special weaves, such as lenoweaves, in which the weft and warp yarns are immobilized by twisting, are specifically excluded from this definition.

The term "air textured" as used herein refers to a yarn, and in particular polyolefin yarn, which has been textured using an air jet method.

Other terms used herein have definitions which are generally accepted in the art. Such terms are often defined in standard reference texts, such as "Man-Made Fiber and Textile Dictionary" published in 1978 by Celanese Corporation.

One major objective of the carpet industry is to produce high quality carpet using low cost materials; thus, the use of synthetic carpet backings has increased substantially in recent years. One area of improvement has been the introduction of inexpensive air-textured polyolefin yarns. These are produced by feeding a ribbon of polyolefin through an air jet in such a way that the yarn is bulked. Two types of yarns which can be produced in this way are nodally entangled and continuously entangled yarns.

If one were to select a carpet backing strictly on the basis of cost, a very important backing would comprise an open-weave, plain-weave fabric produced from nodally entangled, low denier yarn. However, this type of backing has proved to be unsatisfactory for a number of reasons.

The process of attaching a secondary backing to a primary backing usually involves the unwinding of the desired secondary backing through pin rolls and then affixing the backing to a tenter frame. As the fabric is unwound it is placed under tension and, if it is not dimensionally stable, it tends to elongate or "neck in." At the same time, the across machine direction pull on the fabric from the tenter pins causes the selvedge edge warp yarns to pull out or distort. As a result, the fabric bows and skews, and this often leads to problems of delamination of the secondary backing from the primary backing.

The bow and skew problem is usually attributable to the texture and/or the friction characteristics of the yarn, particularly with plain-weave fabrics. Conventional natural yarns such as jute have rough textures and the strands do not slide easily against and across one another; thus, they are bow and skew resistant. Polyolefin yarn, on the other hand, is very smooth and slippery, and the strands readily slide back and forth. This ease of movement in the environment of the tentering process results in the problems referred to above whereby the tentered polyolefin fabric is bowed and skewed. That the art recognizes these problems and has been unable to satisfactoryily resolve them may be readily determined by reference to U.S. Pat. No. 4,145,467, the contents of which are hereby incorporated by reference.

Surprisingly, applicant has discovered that this problem may be conveniently and inexpensively overcome by treating plain-weave, air-textured yarn fabrics with a relatively dilute vinyl acetate-ethylene copolymer emulsion comprising from about 1 to about 25% solids. Emulsions of this type, which are commonly called EVA latex emulsions, are described in U.S. Pat. No. 4,239,563, the contents of which are also herein incorporated by reference. This patent teaches that EVA emulsions are useful at levels of about 23–37 ounces per square yard (dry weight) as adhesives for adhering polyolefin secondary carpet backing to primary backing. It is also indicated that a minimum solids content of 50% is needed to provide excellent tuft lock, bundle wrap and T-peel.

Applicant's invention is practiced in a way which is neither taught nor contemplated by the prior art. Commercially available EVA latexes having approximately 50% solids content may be diluted to provide an emulsion which is suitable for application to a plain-weave air-textured polyolefin fabric. Application may be accomplished by any suitable means, such as by spraying, dipping, padding and the like, after which the fabric is dried. However, a number of variables must be considered. These include the denier of the yarn fiber, the tightness of the weave, the type of air texturing process which was used to prepare the yarn, the amount of EVA latex (dry weight) which is deposited on the fabric, and the solids content of the latex.

In general, the tighter the weave and the heavier the denier of the yarn, the greater will be the bow and skew resistance of the fabric; thus, less EVA latex will be required. However, tightly woven heavy-denier fabric will tend to pick up and retain the EVA latex more easily than open, lighter fabrics because there is more surface area. Over-deposition of the latex is detrimental, not only from a cost standpoint, but also from a performance standpoint, as discussed more fully below.

The denier of the bulked yarn which will be suitable to practice the present invention can vary from as low as 500 denier to as high as 6000 denier. Nevertheless, preferably the denier will be from about 700 to about 3000, and most preferably from about 1000 to about 1800.

When practicing the present invention, it is not necessary that identical yarn be used in both directions. Thus, one type and size of air-textured yarn could be used as the warp yarn and another type and size could be used as the weft yarn. In addition, the tightness of the weave might be varied such that warp yarns were tightly woven whereas weft yarns were openly woven, and vice versa. Thus, the weave count might be varied from about 4 to about 16 per inch in the warp direction, and from about 4 to about 16 per inch in the weft direction, depending on the use to which the fabric would be put.

Using the aformentioned data as background information, the object of the present invention will be to coat the yarn fibers with sufficient EVA latex such that, when dried, the fabric will be dimensionally stable and will be bow and skew resistant. To meet this objective, the dry weight of EVA latex which is deposited on the fabric will usually vary from about 0.02 to about 3.0 ounces per square yard. However, preferably the amount deposited will be about 0.03 to about 0.5 ounces per square yard and, most preferably, from about 0.03 to about 0.15 ounces per square yard. In addition, the solids content of the latex should not exceed about 25% by weight and, preferably, should be not more than about 10% by weight. Most preferably, the solids content should be not more than about 5% by weight.

The amount which is deposited will depend upon the above factors, as well as on the characteristics of the air-textured fabric. For example, nodally entangled yarns, such as those described in U.S. Pat. No. 4,064,686, tend to be flat in nature and, when treated according to the present invention, the flat strands tend to be readily adhered to one another. For that reason, relatively low levels of EVA latex will be suitable to provide good dimensional stability.

Conversely, continuously entangled yarns tend to be round in nature, which minimizes the contact between the fibers, thus requiring a proportionately greater amount of EVA latex. Because of these differences, the latter fabric requires higher levels of latex to achieve comparable dimensional stability, assuming that other factors such as denier, weave density, and the like are the same.

As suggested above, increasing the level of deposited latex can be detrimental. At high solids levels, blocking (the adherence of the fabric to itself when stored in a layer-upon-layer configuration) can become a factor because the latex tends to remain on the surfaces of the fibers where it can cross bond. The ability of a fabric to absorb the latex, as well as fiber geometry, are factors which will affect blocking. However, as a general rule, blocking can usually be minimized if (1) a solids content of not more than about 25% is employed for the latex and (2) the application level of the latex is controlled. The latter consideration will depend to a great extent, of course, on the factors described above.

The present invention will be more readily visualized by reference to the following examples, which are presented by way of illustration and not by way of limitation.

EXAMPLES

The polypropylene fabric used in the following examples was prepared as follows. A fibrillated, roll-embossed ribbon yarn was produced essentially as described in U.S. Pat. No. 4,145,467 and wound on spools. Subsequently the yarn was air textured using an Enterprise continuous-entanglement air-texturizing apparatus. In addition, nodally entangled yarn was prepared using the same apparatus in combination with a Plaitloc air jet. The average denier of the continuously entangled yarn was about 1410 whereas the denier of the nodally entangled yarn was about 1365. These yarns were then used to prepare plain-weave fabrics. For comparison a plain-weave jute fabric comprising yarn having a denier of about 2200 was used, as was an Action-Bac fabric. Action-Bac is a lenoweave fabric which, in this instance, comprised 500 denier tape yarn and 1650 denier weft yarn.

The following examples of secondary backing material were subjected to a test designed to measure their resistance to elongation. Where applicable, 5"×9" polypropylene plain-weave samples were dipped in a vinyl acetate-ethylene copolymer emulsion having the indicated solids content. The dipped samples were then padded twice at 10 pounds per lineal inch in a squeeze roll and dried for 10 minutes at 250° F., at which time the weight of deposited solids was determined. Test samples 2"×6" were cut diagonally (45°) to the weave for the treated and untreated samples, and each end of a given sample was placed in the jaws of an Instron tensile testing device. When the jaws were separated, the pull in pounds necessary to cause a 2.5% elongation of the sample was measured. The following results were obtained.

| Sample | Untreated Samples: Fabric Basis Weight (oz./yd$^2$) | Pull (lbs.) to Cause 2.5% Elongation |
|---|---|---|
| I. Action-Bac (lenoweave, 16 × 8 weave count) | 2.8 | 0.11 |
| II. Jute (plain weave, 10 × 10 weave count) | 5.7 | 0.08 |
| III. Plaitloc nodally entangled fiber (plain weave, 8.3 × 8.3 weave count) | 3.2 | 0.03 |
| IV. Enterprise continuously entangled fiber (plain weave, 8.3 × 8.3 weave count) | 3.3 | 0.02 |

| Sample | Treated Samples: EVA Solids Content (Wt. %) | Dry Weight of added EVA (oz./yd.) | Pull (lbs.) to Cause 2.5% Elongation |
|---|---|---|---|
| IIIa. | 2 | 0.03 | 0.06 |
| IIIb. | 5 | 0.12 | 0.12 |
| IIIc. | 10 | 0.17 | 0.12 |
| IIId. | 25 | 0.98 | 1.50 |
| IVa. | 2 | 0.04 | 0.07 |
| IVb. | 5 | 0.07 | 0.05 |
| IVc. | 10 | 0.12 | 0.05 |
| IVd. | 25 | 0.38 | 0.20 |

These results were analyzed mathematically for each sample by plotting the pull necessary to cause 2.5% elongation versus the dry weight of deposited latex and analyzing the resulting curves using regression analysis. These data indicated that treated nodally entangled fabrics demonstrated about 3 times the resistance to elongation than did treated continuously entangled fabrics. In addition, treatment caused a marked improvement in performance for the air textured fabrics such that they could, in certain instances, become comparable in elongation resistance to the more expensive plain-weave jute and lenoweave synthetic fabrics.

Blocking tests were also measured by stacking six 4"×4" pieces of treated fabric, placing the stack under a pressure of 25 psi, and treating the samples at 90% relative humidity and 100° F. These tests indicated that blocking tended to be more of a problem as the solids content of the latex approached 25%.

The present invention is not restricted solely to the description and illustrations provided above, but encompasses all modifications envisaged by the following claims.

What is claimed is:

1. A bow and skew resistant plain-weave polyolefin fabric, said fabric comprising air-textured yarn and being coated with a vinyl acetate-ethylene copolymer emulsion at a dry weight deposition level of from about 0.02 to about 3.0 ounces per square yard of fabric, said emulsion comprising not more than about 25% solids by weight.

2. The invention as set forth in claim 1 hereof wherein said deposition level is from about 0.03 to about 0.5 ounces per square yard.

3. The invention as set forth in claim 1 hereof wherein said deposition level is from about 0.03 to about 0.15 ounces per square yard.

4. The invention as set forth in claim 1 hereof wherein said solids content of said emulsion is not more than about 10% by weight.

5. The invention as set forth in claim 2 hereof wherein said solids content of said emulsion is not more than about 10% by weight.

6. The invention as set forth in claim 3 hereof wherein said said solids content of said emulsion is not more than about 10% by weight.

7. The invention as set forth in claim 3 hereof wherein said solids content of said emulsion is not more than about 5% by weight.

8. The invention as set forth in claim 4 hereof wherein said fabric is an open-weave fabric having a weave count of from about 4 to about 16 in each direction, the yarn having a denier of from about 500 to about 6,000 and being nodally entangled.

9. The invention as set forth in claim 6 hereof wherein said fabric is an open-weave fabric having a weave count of from about 4 to about 16 in each direction, the yarn having a denier of from about 500 to about 6,000 and being nodally entangled.

10. The invention as set forth in claim 7 hereof wherein said fabric is an open-weave fabric having a weave count of from about 4 to about 16 in each direction, the yarn having a denier of from about 500 to about 6,000 and being nodally entangled.

11. The invention as set forth in claim 9 hereof wherein said denier is from about 700 to about 3,000.

12. The invention as set forth in claim 10 hereof wherein said denier is from about 700 to about 3,000.

13. The invention as set forth in claim 10 hereof wherein said denier is from about 1,000 to about 1,800.

14. The invention as set forth in claim 13 hereof wherein said fabric comprises polypropylene fibers.

15. A process for preparing a bow and skew resistant plain-weave polyolefin fabric, said process comprising the steps of selecting a plain-weave polyolefin fabric prepared from air textured yarn, treating said fabric with a vinyl acetate-ethylene copolymer emulsion comprising not more than about 25% solids by weight, said emulsion being applied at a dry-weight level of about 0.02 to about 3.0 ounces per square yard of fabric, and drying said fabric.

16. The invention as set forth in claim 15 hereof wherein said deposition level is from about 0.03 to about 0.5 ounces per square yard.

17. The invention as set forth in claim 15 hereof wherein said deposition level is from about 0.03 to about 0.15 ounces per square yard.

18. The invention as set forth in claim 15 hereof wherein said solids content of said emulsion is not more than about 10% by weight.

19. The invention as set forth in claim 16 hereof wherein said solids content of said emulsion is not more than about 10% by weight.

20. The invention as set forth in claim 17 hereof wherein said solids content of said emulsion is not more than about 10% by weight.

21. The invention as set forth in claim 17 hereof wherein said solids content of said emulsion is not more than about 5% by weight.

22. The invention as set forth in claim 18 hereof wherein said fabric is an open-weave fabric having a weave count of from about 4 to about 16 in each direction, the yarn having a denier of from about 500 to about 6,000 and being nodally entangled.

23. The invention as set forth in claim 20 hereof wherein said fabric is an open-weave fabric having a weave count of from about 4 to about 16 in each direction, the yarn having a denier of from about 500 to about 6,000 and being nodally entangled.

24. The invention as set forth in claim 21 hereof wherein said fabric is an open-weave fabric having a weave count of from about 4 to about 16 in each direction, the yarn having a denier of from about 500 to about 6,000 and being nodally entangled.

25. The invention as set forth in claim 23 hereof wherein said denier is from about 700 to about 3,000.

26. The invention as set forth in claim 24 hereof wherein said denier is from about 700 to about 3,000.

27. The invention as set forth in claim 24 hereof wherein said denier is from about 1,000 to about 1,800.

28. The invention as set forth in claim 27 hereof wherein said fabric comprises polypropylene fibers.

* * * * *